United States Patent [19]

Robins et al.

[11] 3,932,683

[45] Jan. 13, 1976

[54] CONTROL OF COATING THICKNESS OF HOT-DIP METAL COATING

[75] Inventors: Norman A. Robins, Flossmoor; Frank H. Bugajski, South Holland, both of Ill.

[73] Assignee: Inland Steel Company, Chicago, Ill.

[22] Filed: Oct. 10, 1972

[21] Appl. No.: 296,293

[52] U.S. Cl. ..... 427/349; 427/433; 427/436; 118/63

[51] Int. Cl.[2].... C23C 1/04; C23C 1/06; C23C 1/08

[58] Field of Search..... 117/114 R, 114 A, 114 C, 117/102 M, 102 R; 118/63; 427/349, 436, 433

[56] References Cited

UNITED STATES PATENTS

| | | | |
|---|---|---|---|
| 3,406,656 | 2/1967 | Patterson | 117/114 A |
| 3,459,587 | 8/1969 | Hunter et al. | 117/114 B |
| 3,607,366 | 9/1971 | Kurokawa | 117/102 X |
| 3,681,118 | 2/1970 | Ohama et al. | 117/114 C |

*Primary Examiner*—Ralph S. Kendall
*Assistant Examiner*—Edith R. Buffalow
*Attorney, Agent, or Firm*—Hibben, Noyes & Bicknell

[57] ABSTRACT

Objectionable ripple formation in continuous hot-dip coating is avoided by using a single set of blowing nozzles and directing the gas streams downwardly against the strip at an angle between the strip and the center line of the gas stream of from about 0° to about 45°, preferably from about 20° to about 40°. The technique is particularly useful at low line speeds of 150 feet per minute or less, especially at high coating weights of 1.5 ounces per square foot or more.

8 Claims, 3 Drawing Figures

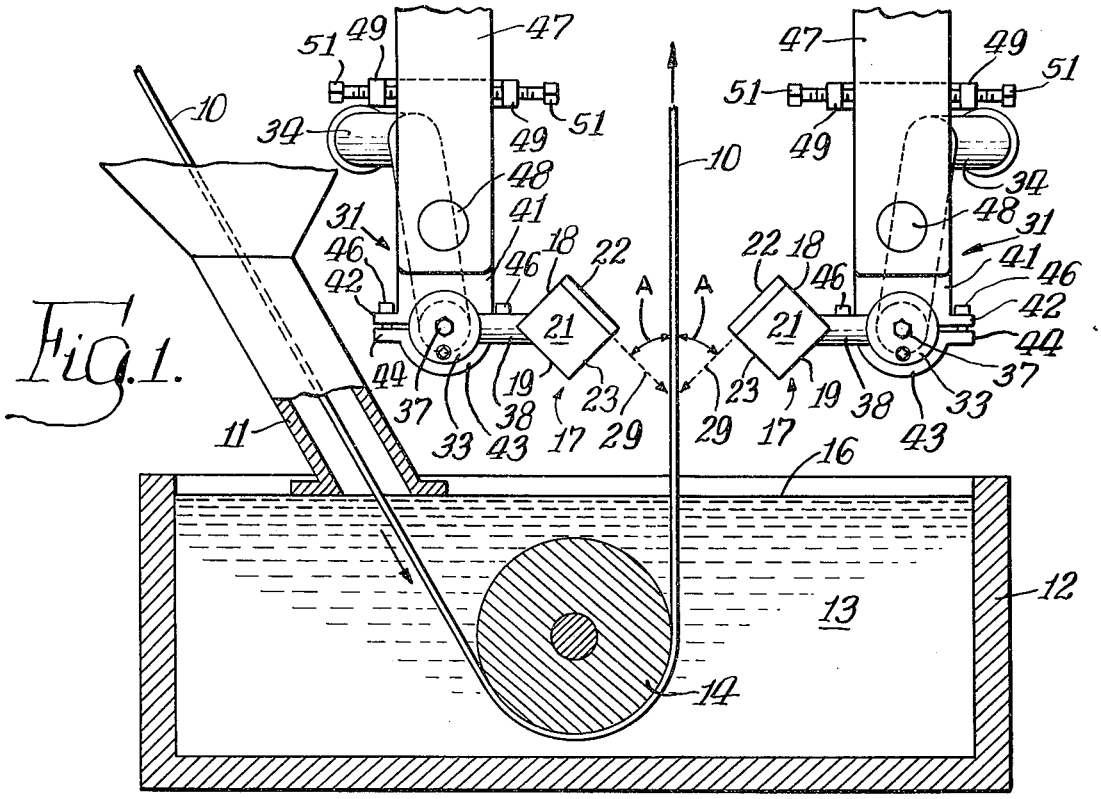
Fig. 1.
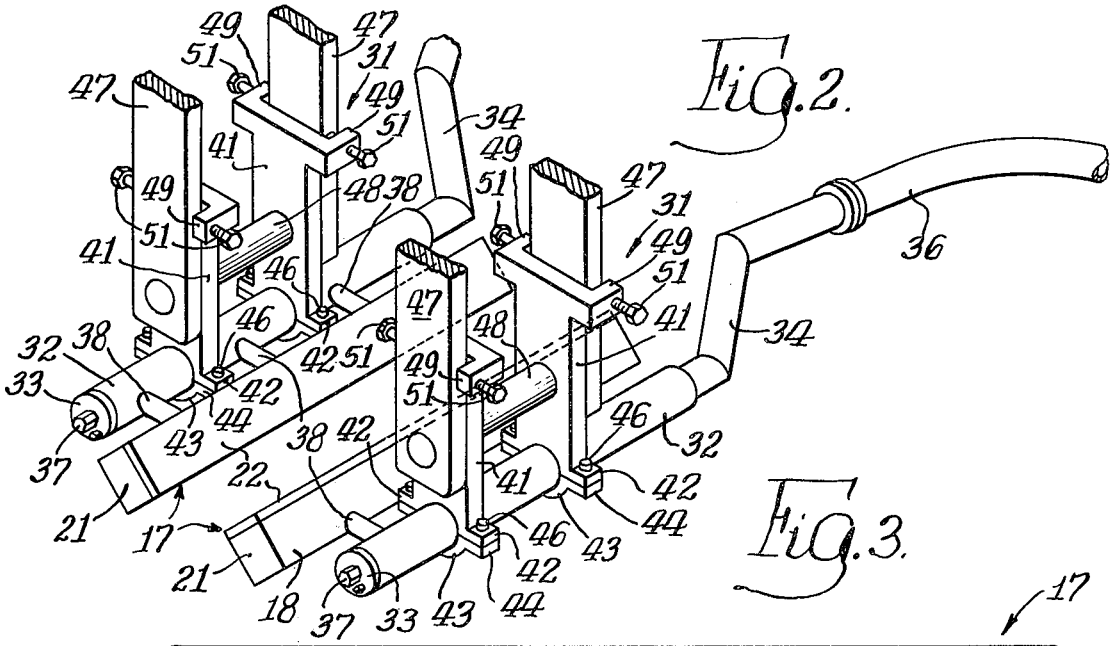
Fig. 2.
Fig. 3.

CONTROL OF COATING THICKNESS OF HOT-DIP METAL COATING

This invention relates to improvements in continuous hot dip metal coating of a metallic substrate. More particularly, the invention relates to improvements in the control of coating thickness in continuous hot dip coating of steel strip with a molten coating metal such as zinc, aluminum, lead, tin, or alloys thereof.

In continuous hot dip galvanizing and aluminum coating of steel strip it has been customary for many years to pass the steel strip from a preliminary heating and treating step downwardly into a bath of molten coating metal and thence upwardly between a pair of exit rolls at the surface of the bath for controlling the thickness of the coating on the strip. Because of certain well recognized disadvantages of the use of coating rolls, an improved technique has been introduced in recent years which consists in passing the strip upwardly from the bath between a pair of blowing nozzles (sometimes referred to as "air knives") which direct high velocity sheets or streams of gas at a regulated pressure and temperature against the opposite surfaces of the upwardly moving strip. The gas blowing technique is described, for example, in such prior art patents as U.S. Pat. Nos. 3,406,656, 3,459,587, and 3,499,418 and British Pat. No. 1,071,572.

Although it has been suggested in the prior art that substantially perpendicular impingement of the gas streams against the strip is the preferred mode of operation, it has been found that with this practice an objectionable surface defect in the coated strip is frequently encountered in the form of thin lines or stripes of heavier coating deposits extending across the width of the strip and spaced more or less regularly along the length of the strip to impart a generally rippled appearance. When the impingement gas is directed substantially perpendicularly against the strip, the gas stream splits and a substantial portion of the gas stream is diverted upwardly along the still molten coating. It has been determined that this upwardly flowing branch of the gas stream is a primary cause of ripples in the molten surface, in a manner analogous to wave formation when wind blows over the surface of a body of water.

In U.S. Pat. No. 3,607,366 it has been suggested that ripples can be avoided by utilizing a second set of blowing nozzles positioned above the primary nozzles and directed downwardly toward the primary nozzles so as to counteract or cancel out the ripple-producing effect of the upwardly flowing branches of the gas streams from the primary nozzles. However, such apparatus is complex and cumbersome, requires careful control, and obviously increases the equipment and operating costs. We have discovered that such undesirable ripples can be eliminated or effectively minimized by using only a single set of blowing nozzles positioned at a critical angle with respect to the strip and that the use of the critical blowing angle is particularly advantageous when operating at relatively low line speeds, especially when relatively heavy coatings are desired.

Accordingly, a primary object of the present invention is to provide a novel and improved method of utilizing gas impingement for controlling coating thickness in continuous hot-dip metal coating of a metal strip.

A further object of the invention is to provide a novel and improved method of avoiding ripples in the coated surface when using gas impingement for controlling coating thickness in continuous hot-dip metal coating of a metal strip.

Another object of the invention is to provide a novel and improved method of avoiding ripples during continuous hot-dip metal coating which has particular utility at relatively low line speeds, especially for relatively heavy coating weights.

Other objects and advantages of the invention will be apparent from the subsequent detailed description in conjunction with the accompanying drawing, wherein:

FIG. 1 is a generally schematic view of one specific embodiment of a hot dip coating apparatus for practicing the invention;

FIG. 2 is a fragmentary perspective view of the nozzles and nozzle supports of the apparatus shown in FIG. 1; and FIG. 3 is a perspective view of one of the blowing nozzles of the apparatus shown in FIGS. 1 and 2.

Contrary to the prior art beliefs, we have discovered that ripple formation can be avoided or effectively minimized by using only a single set of blowing nozzles positioned so as to direct the gas streams downwardly against the strip at a predetermined critical angle instead of substantially perpendicularly against the strip. In this way, the upward flow of impingement gas is either eliminated or significantly reduced, thereby removing the primary cause of ripple formation. Although the angular blowing technique of the present invention is effective in avoiding ripple formation under a wide variety of operating conditions, the invention has particular advantages when relatively low line speeds are necessary, especially when relatively heavy coatings are being applied. Heretofore, when operating at low line speeds, e.g. 150 feet per minute or less, it has been necessary to revert to the use of conventional prior art coating rolls for control of coating thickness in order to avoid the ripple problem. This has been true especially when applying heavier coatings, e.g. 1.5 ounces per square foot or higher, at the low line speeds.

Although the invention is not limited to any particular apparatus, the drawing shows one specific form of apparatus which has been found to be useful in carrying out the angular blowing method herein described. Referring to FIGS. 1–3, a hot dip coating apparatus of the Sendzimir type is shown wherein a continuous steel strip 10 is passed downwardly through a protective conduit or snout 11 extending from a preheating furnace (not shown) into a pot 12 containing a bath 13 of molten coating metal such as zinc, aluminum, or alloys thereof. The strip 10 passes beneath a conventional sinker roll 14 and extends vertically upwardly from the surface 16 of the bath. The strip with molten coating metal adhering to both surfaces passes between a pair of opposed gas blowing nozzles 17 for controlling the thickness of the coating. Thereafter the strip is cooled and recoiled by conventional means (not shown).

Each nozzle 17 has an elongated rectangular box-like configuration, as best seen in FIG. 3, including a rear wall 18, a bottom wall 19, end walls 21, a top wall 22, and an adjustable front wall 23. The rear, bottom and end walls may be permanently connected, as by welding, and the top wall 22 is removably attached, as by screws 24. Although not shown in the drawing, the hollow interior or chamber of the nozzle 17 is preferably provided with internal baffle means to insure uniform distribution of gas flow, e.g. as described in U.S. Pat. No. 3,360,202. The front wall 23 is mounted by means of a plurality of screws 26 extending through elongated slots 27 so that the wall 23 can be adjustably positioned to define, with the top wall 22, an elongated restricted gas outlet or slit orifice 28 for directing a high velocity stream or sheet of gas against the strip 10. As described below, the nozzles 17 are adjustably supported so that the gas streams from the orifices 28, as indicated by the broken line arrows 29 in FIG. 1, are directed at a predetermined angle A downwardly against the strip 10. Although not shown in FIG. 1, it will be understood that the gas streams 29 emerging from the orifices 28 spread or widen somewhat before impinging against the strip 10. Consequently, the angle A is to be measured between the strip and the center line of the gas stream.

The adjustable support means for the nozzles 17 is designated generally at 31 in FIGS. 1 and 2 and comprises, for each nozzle, a tubular gas manifold 32 having a closure 33 at one end and a gas inlet connection 34 at the other end. The blowing gas, which may comprise air, steam, an inert gas (such as combustion gas), or mixtures thereof, is supplied to the gas inlet 34 through a flexible gas supply line or hose 36 to accommodate movement of the manifold 32. The end closure 33 is provided with a rigid projection 37 of non-circular cross-section which is adapted to be engaged by a wrench or other tool for rotatably adjusting the position of the manifold 32. The manifold 32 is rigidly connected to the nozzle 17 in parallel spaced relation by means of a plurality (in this instance, three) of tubular connectors 38.

The manifold 32 of each nozzle support means 31 is adjustably carried in a pair of spaced brackets, each comprising an upright plate member 41 having a semicircular end recess with flanges 42 and a complementary semi-circular bottom saddle portion 43 with flanges 44. The manifold 32 is received in the circular openings defined by the plate members 41 and the saddle portions 43, and the manifold 32 is clamped in any desired rotary position by means of screws 46 extending through and interconnecting the flanges 42 and 44. As will be readily apparent, the positions of the nozzles 17 can be regulated by manipulating the end projections 37 and rotating the manifolds 32 about their respective axes so as to vary the blowing angle A (FIG. 1) between the center line of each gas stream 29 and the strip 10.

The bracket plate members 41 of each nozzle support means 31 are removably attached to the lower ends of a pair of elongated upright support members 47 (shown fragmentarily in FIGS. 1 and 2) by means of a removable connecting pin or bar 48 extending through aligned openings in the overlapping members 41 and 47. The upper end portion of each bracket plate member 41 is provided with transversely projecting ears 49 which extend in spaced relation adjacent the longitudinal side edges of the support members 47, and adjusting screws 51 are mounted in the ears 49 with their inner ends engaging the edges of the support members 47 for preventing rotation of the nozzle support brackets about the axis of the pin 48 and for holding the bracket plate members 41 in any desired degree of alignment with the lower ends of the support members 47.

Although not illustrated in the drawing, it should be understood that the support members 47 depend from the usual carriage means (not shown) mounted above the pot 12 for adjusting the elevation of the nozzles 17 above the bath surface 16 and for moving the nozzles 17 toward or away from the strip 10. In general, the elevation or vertical distance of the nozzles above the bath surface will be adjusted so that the gas streams impinge on the strip as close as possible to the bath surface but far enough away to avoid detrimental splashing of the molten metal bath. The distance between the nozzles and the strip and the pressure of the blowing gas are selected to produce the desired coating thickness or coating weight.

In accordance with our invention, the blowing angle A between the strip 10 and the center line of the gas stream 29 should be from about 0° to about 45°, and preferably from about 20° to about 40°, in order to eliminate or substantially minimize ripple formation on the coated strip. The optimum blowing angle within this range will vary somewhat depending upon various factors but principally upon the line speed and the composition of the coating bath or spelter 13. By means of the rotary adjustment described above, it is a simple matter to regulate the angle A so as to obtain the most effective control over ripple formation for any given coating operation.

In general, the line speed of a continuous hot-dip coating line is limited by the capacity of the preheating furnace and the degree of heat treatment required for the strip being processed. When it is possible to use relatively high line speeds, ripple formation is less frequently encountered and often can be avoided even when the blowing gas is impinged substantially perpendicularly against the strip. At relatively high line speeds, ripple formation can be effectively prevented by the angular blowing method of the present invention although it is not always necessary to use angular blowing to achieve this result.

However, there are many occasions when high line speeds cannot be used, such as when a relatively heavy gauge strip is being processed or when for other reasons a longer residence time is required in the preheating furnace, e.g. to impart the desired ductility to the strip. At relatively low line speeds not in excess of about 150 feet per minute, e.g. from about 40 to about 100 feet per minute, it has been found that ripple formation is a particularly serious problem when using perpendicular or substantially perpendicular gas impingement. As mentioned above, it has been considered necessary heretofore to abandon the gas blowing technique under such circumstances and to revert to the use of conventional coating rolls in order to obtain a coated product having acceptable surface appearance. The problem is especially acute when the line is being operated at a relatively low speed to obtain a relatively heavy coating weight, e.g. about 1.5 ounces per square foot or more, particularly from about 1.5 to about 3 ounces per square foot (both sides of the strip). When perpendicular gas impingement is employed under such conditions, either the coating weight is too light or an unacceptable rippled surface is obtained.

By means of the present invention, where the downward blowing angle of the gas stream as measured between the strip and the center line of the gas stream is between about 0° and about 45°, particularly from about 20° to about 40°, it is possible to obtain an acceptable substantially ripplefree surface at any desired coating weight over a wide range of line speed. Thus, with the present invention it becomes possible to avoid the expense and inconvenience of resorting to the use of conventional coating rolls when making certain types of coated products. In particular, the present invention makes it possible to obtain an acceptable ripple-free coating appearance at low line speeds of about 150 feet per minute or less and relatively heavy coating weights of about 1.5 ounces per square foot or more, an achievement not possible when using substantially perpendicular blowing.

Although the invention has been described herein with reference to a particular structural embodiment of an apparatus for carrying out the disclosed method, it is to be understood that the invention is not so limited and that other forms of apparatus may be utilized without departing from the scope of the invention as defined in the appended claims.

We claim:

1. In a continuous hot-dip coating line wherein a metal strip is passed through a molten coating bath at a line speed not greater than about 150 feet per minute and is withdrawn vertically from the bath between a pair of gas blowing nozzles for impinging only a single stream of gas against each side of said strip and thereby controlling the coating thickness, the improvement which comprises directing the gas stream from each of said nozzles generally downwardly against the strip at an angle between the strip and the center line of the gas stream of not more than about 40°, whereby to eliminate or substantially minimize ripple formation on the surface of the coated product.

2. The improvement of claim 1 further characterized in that said angle is from about 20° to about 40°.

3. The improvement of claim 1 further characterized in that said line speed is from about 40 to about 100 feet per minute.

4. The improvement of claim 1 further characterized in that the line is operated so as to obtain a coating weight of not less than about 1.5 ounces per square foot.

5. The improvement of claim 1 further characterized in that said line speed is from about 40 to about 100 feet per minute and the line is operated so as to obtain a coating weight of not less than about 1.5 ounces per square foot.

6. The improvement of claim 1 further characterized in that the line is operated to obtain a coating weight of from about 1.5 to about 3 ounces per square foot.

7. The improvement of claim 1 further characterized in that said line speed is from about 40 to about 100 feet per minute and the line is operated so as to obtain a coating weight of from about 1.5 to about 3 ounces per square foot, and said angle is from about 20° to about 40°.

8. The improvement of claim 1 further characterized in that said strip is steel and said coating bath is a metal selected from the group consisting of zinc, aluminum, and alloys thereof.

* * * * *